US008113518B2

(12) United States Patent
Rosen

(10) Patent No.: US 8,113,518 B2
(45) Date of Patent: Feb. 14, 2012

(54) MULTI-DIMENSIONAL PUZZLE

(76) Inventor: Lawrence I. Rosen, Mendham, NJ (US)

( * ) Notice: Subject to any disclaimer, the term of this patent is extended or adjusted under 35 U.S.C. 154(b) by 65 days.

(21) Appl. No.: 12/576,726

(22) Filed: Oct. 9, 2009

(65) Prior Publication Data

US 2010/0090400 A1 Apr. 15, 2010

Related U.S. Application Data

(60) Provisional application No. 61/105,022, filed on Oct. 13, 2008.

(51) Int. Cl.
*A63F 9/10* (2006.01)

(52) U.S. Cl. ..... 273/157 R

(58) Field of Classification Search ..... 273/157 R, 273/157 A, 156; 434/365
See application file for complete search history.

(56) References Cited

U.S. PATENT DOCUMENTS

| | | | | | |
|---|---|---|---|---|---|
| 1,964,007 | A | * | 6/1934 | Parks | 273/157 R |
| 3,107,918 | A | | 10/1963 | Edlen | |
| 3,647,218 | A | * | 3/1972 | Foley et al. | 273/157 R |
| 3,682,479 | A | | 8/1972 | Miller et al. | |
| 4,205,850 | A | * | 6/1980 | Craig | 273/157 R |
| 4,257,606 | A | | 3/1981 | Launzel | |
| 4,469,331 | A | | 9/1984 | Rinker | |
| 4,494,935 | A | * | 1/1985 | Miller | 273/157 R |
| 4,815,742 | A | | 3/1989 | Augustine | |
| 4,874,176 | A | | 10/1989 | Auerbach | |
| 5,165,689 | A | * | 11/1992 | Forsse et al. | 273/157 R |
| 5,251,900 | A | | 10/1993 | Gallant | |
| 5,351,957 | A | * | 10/1994 | Scott | 273/157 R |
| 5,362,054 | A | * | 11/1994 | Ashemimry | 273/157 R |
| 5,624,118 | A | * | 4/1997 | Gottesman | 273/157 R |
| 5,785,319 | A | * | 7/1998 | Frauhiger | 273/157 R |
| 5,791,647 | A | * | 8/1998 | Reiling | 273/157 R |
| 5,860,650 | A | | 1/1999 | Scobbie et al. | |
| 6,237,914 | B1 | * | 5/2001 | Saltanov et al. | 273/157 R |
| 6,276,525 | B1 | * | 8/2001 | Kobeluch et al. | 273/157 R |
| 6,623,007 | B2 | | 9/2003 | Logue | |
| 2002/0140168 | A1 | | 10/2002 | Liu | |

* cited by examiner

*Primary Examiner* — Steven Wong
(74) *Attorney, Agent, or Firm* — Greenberg Traurig, LLP

(57) ABSTRACT

A multi-dimensional puzzle is formed from a first jigsaw puzzle made from a first set of inter-fitting puzzle pieces and a second jigsaw puzzle made from a second set of inter-fitting puzzle pieces. The second jigsaw puzzle is mounted above the first jigsaw puzzle through the use of platforms positioned on mounting blocks, thus creating a spaced relationship between the first jigsaw puzzle and the second jigsaw puzzle and giving the multi-dimensional puzzle a three-dimensional look.

25 Claims, 6 Drawing Sheets

MULTI-DIMENSIONAL PUZZLE

CROSS-REFERENCE TO RELATED APPLICATION

The present application claims the benefit of U.S. Provisional Patent Application Ser. No. 61/105,022 filed Oct. 13, 2008, the disclosure of which is incorporated herein by reference in its entirety.

FIELD OF THE INVENTION

The present invention relates to puzzles, and, more particularly, to multi-dimensional jigsaw puzzles and the like.

BACKGROUND OF THE INVENTION

Jigsaw puzzles have long been used to challenge, entertain, educate, and/or occupy players of all ages. For example, there exists two-dimensional jigsaw puzzles in which players are assisted in the assembly of the interlocking puzzle pieces by the juxtaposition of the outlines of the pieces that predetermine their desired orientation. Each of the individual puzzle pieces contains a portion of a scene or object which becomes complete as a two-dimensional depiction upon proper assembly of all of the interlocking puzzle pieces.

Three-dimensional variants have also been proposed in the past. Examples of three-dimensional patents are U.S. Pat. Nos. 4,469,331, 4,257,606, and 3,107,918.

SUMMARY OF THE INVENTION

The present invention relates to a novel multi-dimensional puzzle that comprises a first jigsaw puzzle which, when assembled, can be combined with a second jigsaw puzzle and/or three-dimensional objects or puzzles, whose positioning is determined by visual indicia displayed on the first jigsaw puzzle. To achieve a three-dimensional look, the two jigsaw puzzles can be mounted in a spaced-apart relationship one above the other, with the upper puzzle representing part (i.e., one or more specific objects, scenes, etc.) of the lower puzzle, but not the entire lower puzzle.

The assembly of the multi-dimensional puzzle constructed in accordance with the present invention can challenge the players to add visual reliefs to conventional two-dimensional jigsaw puzzles. For instance, after completing a jigsaw puzzle that depicts a house located on a landscaped residential lot, the players may construct a smaller puzzle that depicts just the house itself. This smaller puzzle is then placed on a platform that is adapted to mount it on, as well as elevate it from, the scene of the house on the larger jigsaw puzzle. Visual excitement is thereby added to an otherwise ordinary two-dimensional jigsaw puzzle.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

Figure 1:
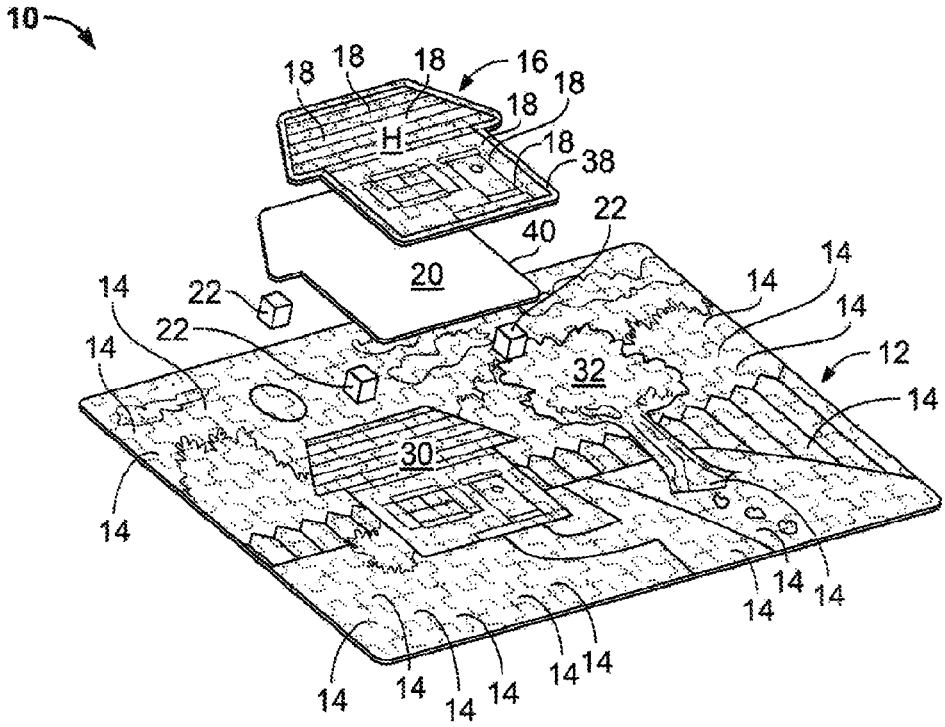
FIG. 1 is an exploded perspective view of a multi-dimensional puzzle constructed in accordance with one exemplary embodiment of the present invention, the multi-dimensional puzzle being defined by a base layer puzzle which is shown separated from a smaller dimensional layer puzzle by a platform and mounting blocks.

FIG. 1 illustrates a multi-dimensional puzzle 10 having four basic component parts which provide puzzle players challenging, satisfying and artistic experiences in assembling the multi-dimensional puzzle 10. More particularly, the component parts include a base layer puzzle 12, which is assembled from a plurality of base layer puzzle pieces 14; a dimensional layer puzzle 16, which is assembled from a plurality of dimensional layer puzzle pieces 18; a platform 20, which supports the dimensional layer puzzle 16; and a plurality of mounting blocks 22, which support the platform 20 in an elevated position above the base layer puzzle 12. Each of the component parts is described in greater detail hereinbelow.

Figure 2:
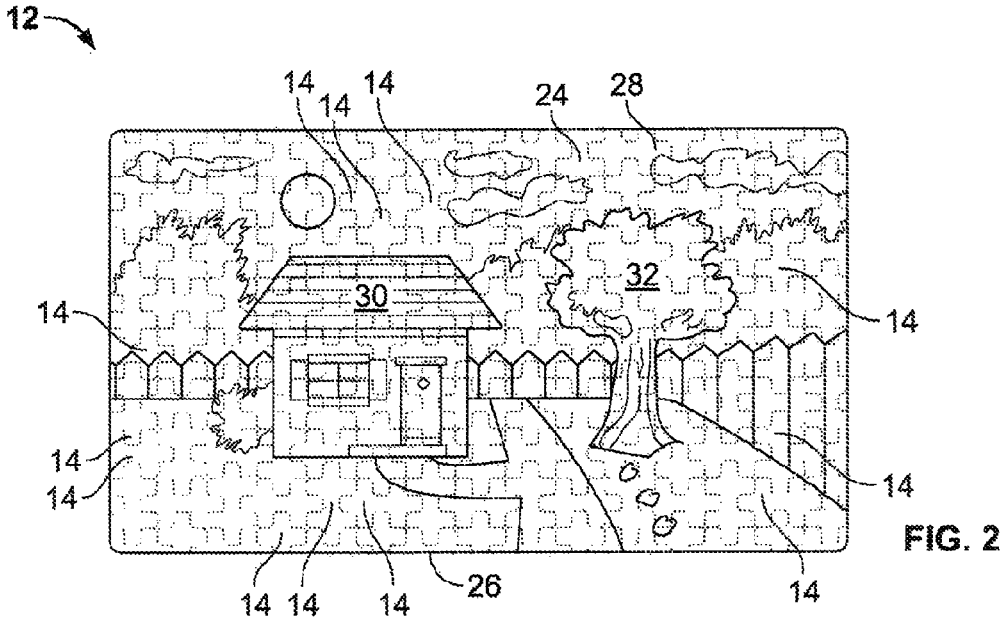
FIG. 2 is a top plan view of the base layer puzzle shown in FIG. 1.

FIG. 2 depicts the base layer puzzle 12, which is in the form of a assembled conventional two-dimensional jigsaw puzzle. As is the case with conventional jigsaw puzzles, the base layer puzzle pieces 14 are interconnected with each other by the juxtaposition of mating corresponding outlines of the pieces 14. Typically, to form the base layer puzzle 12, the puzzle pieces 14 are assembled on a flat surface (not shown) such as a board, plate, or table top, which is suitable for supporting the base layer puzzle 12, as well as for resisting any inadvertent disassembly of same. The base layer puzzle 12 has flat upper and lower surfaces 24, 26, respectively. In this example, the upper surface 24 depicts a residential scene 28, which includes a house scene 30 and a tree scene 32.

Figure 3:
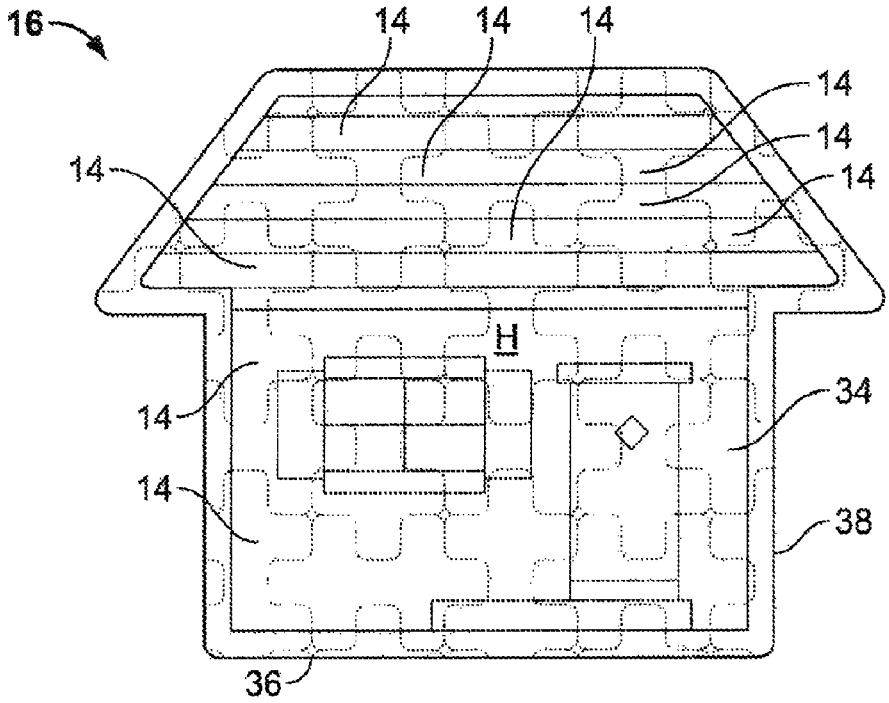
FIG. 3 is a top plan view of the dimensional layer puzzle shown in FIG. 1.

Referring now to FIG. 3, the dimensional layer puzzle 16 is in the form of a assembled conventional two-dimensional jigsaw puzzle. The puzzle 16 is assembled from the dimensional layer puzzle pieces 18, which are interconnected with each other by the juxtaposition of mating corresponding outlines of the pieces 18. Typically, as in the case of the base layer puzzle 12, the dimensional layer puzzle 16 is assembled on a flat surface S such as a table top (see FIG. 9). The dimensional layer puzzle 16 has flat upper and lower surfaces 34, 36, respectively, and an outline 38. In this example, the upper surface 34 contains a scene H which is substantially identical to the house scene 30 of the base layer puzzle 12. More particularly, the size, shape, and pictorial content of the scene H of the dimensional layer puzzle 16 are substantially the same as the size, shape, and pictorial content of the house scene 30 of the base layer puzzle 12. The outlines of the dimensional layer puzzle pieces 18 need not correspond with the outlines of those base layer puzzle pieces 14 that depict the house scene 30, even though they could. In many, if not all, instances, the dimensional layer puzzle pieces 18 have shapes and sizes (i.e., outlines) different than the shapes and sizes (i.e., outlines) of the base layer puzzle pieces 14 that depict the house scene 30. For example, thirty puzzle pieces could comprise the portion of the base layer puzzle pieces 14 that depict the house scene 30, while twenty differently shaped and sized puzzle pieces could comprise the dimensional layer puzzle pieces 18.

Figure 4A:
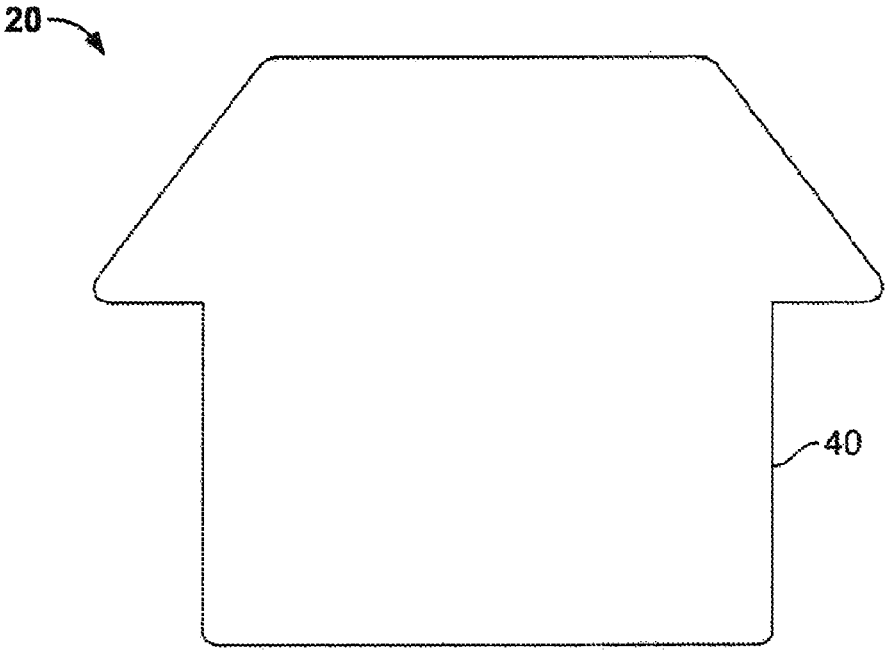
FIG. 4A is a top plan view of the platform shown in FIG. 1.
Figure 4B:
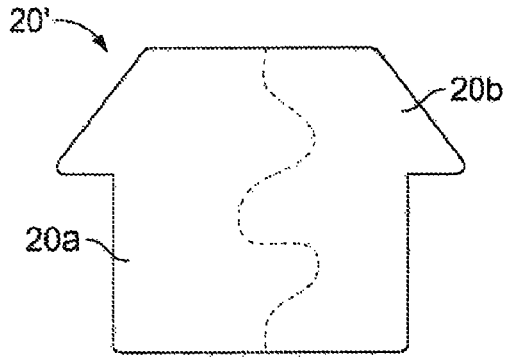
FIG. 4B is a top plan view of a platform that is similar to the platform shown in FIG. 4A, except that it is made from two pieces.

FIG. 4A illustrates the platform 20, which has an outline 40 that is shaped to conform with the outline 38 of the dimensional layer puzzle 16. The platform 20 may be fabricated from a single piece of cardboard, plastic or other suitable material. Alternatively, the platform 20 could be made from a plurality of interfitting pieces (see FIG. 4B which depicts a two-piece platform 20' constructed from pieces 20*a* and 20*b*).

Figure 5:
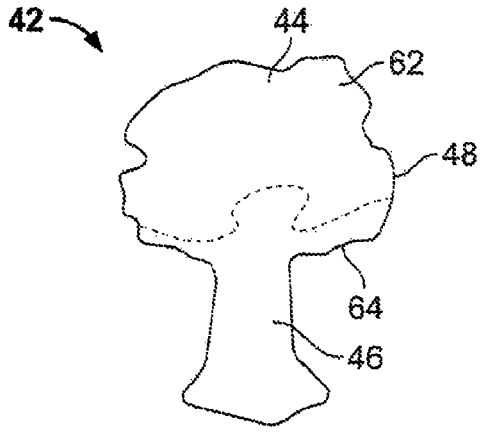
FIG. 5 is a top plan view of another two-piece platform.
Figure 10:
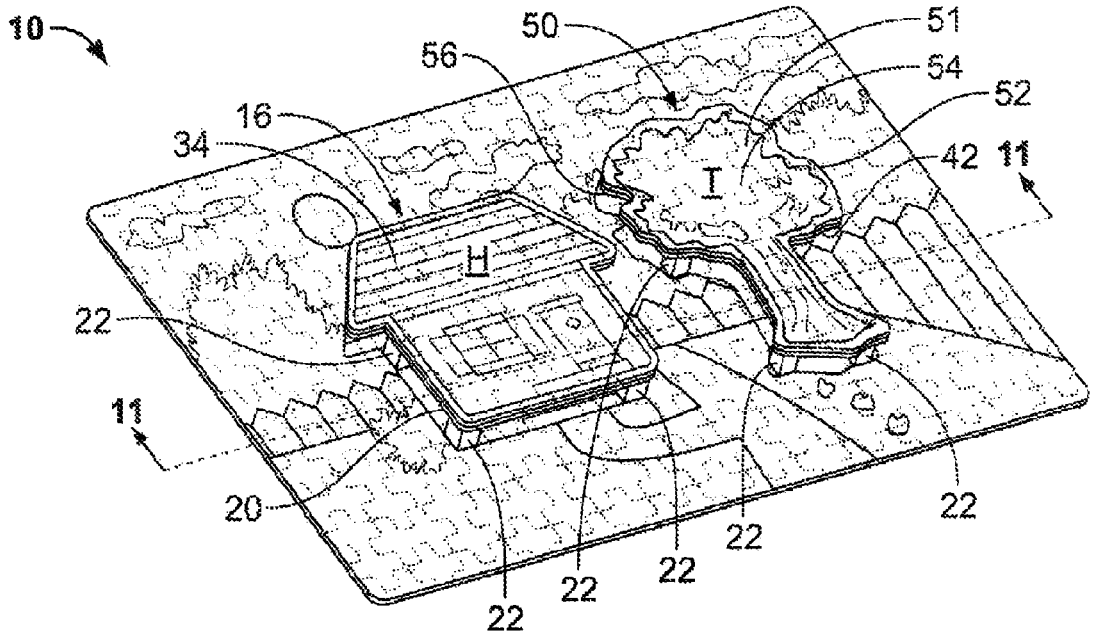
FIG. 10 is a perspective view of the multi-dimensional puzzle shown in FIG. 1, the multi-dimensional puzzle being fully assembled.

Referring to FIG. 5, a second platform 42 is assembled from a plurality of pieces 44, 46 that cooperate to form an outline 48. The platform 42 is sized and shaped to conform with another dimensional layer puzzle 50 (see FIG. 10), which is made from a plurality of dimensional layer puzzle pieces 51. Continuing to refer to FIG. 10, the dimensional layer puzzle 50 has an outline 52, which conforms to the outline 48 of the platform 42. The dimensional layer puzzle 50 also includes upper and lower surfaces 54, 56, respectively. The upper surface 54 contains a scene T, which is substantially identical to the tree scene 32 of the base layer puzzle 12. More particularly, the size, shape, and pictorial content of the scene T of the dimensional layer puzzle 50 are substantially the same as the size, shape, and pictorial content of the tree scene 32 of the base layer puzzle 12. Like the puzzle pieces 18, the puzzle pieces 51 can have outlines that do not necessarily correspond with the outlines of those base layer puzzle pieces 14 that depict the tree scene 32, even though they could. In many, if not, all, instances, the dimensional layer puzzle pieces 51 have shapes and sizes (i.e., outlines) different than the shapes and sizes (i.e., outlines) of the base layer puzzle pieces 14 that depict the tree scene 32. For example, fifteen puzzle pieces could comprise the portion of the base layer puzzle pieces 14 that depict the tree scene 32, while five differently shaped and sized puzzle pieces could comprise the dimensional layer puzzle pieces 51.

Figure 6:
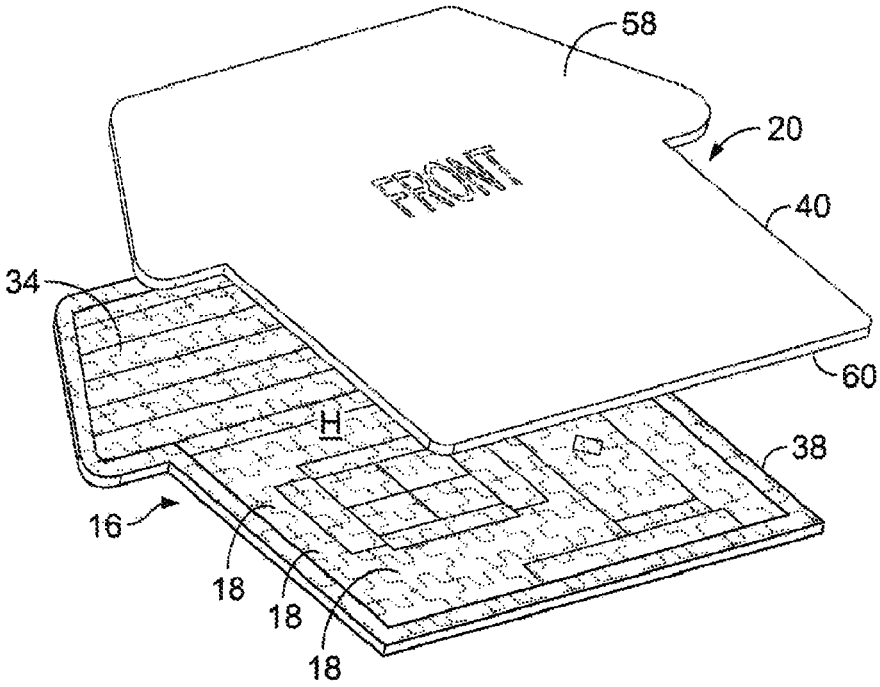
FIG. 6 is perspective view of the dimensional layer puzzle and the platform shown in FIGS. 3 and 4, respectively, the platform being shown positioned with its front side facing up.
Figure 7:
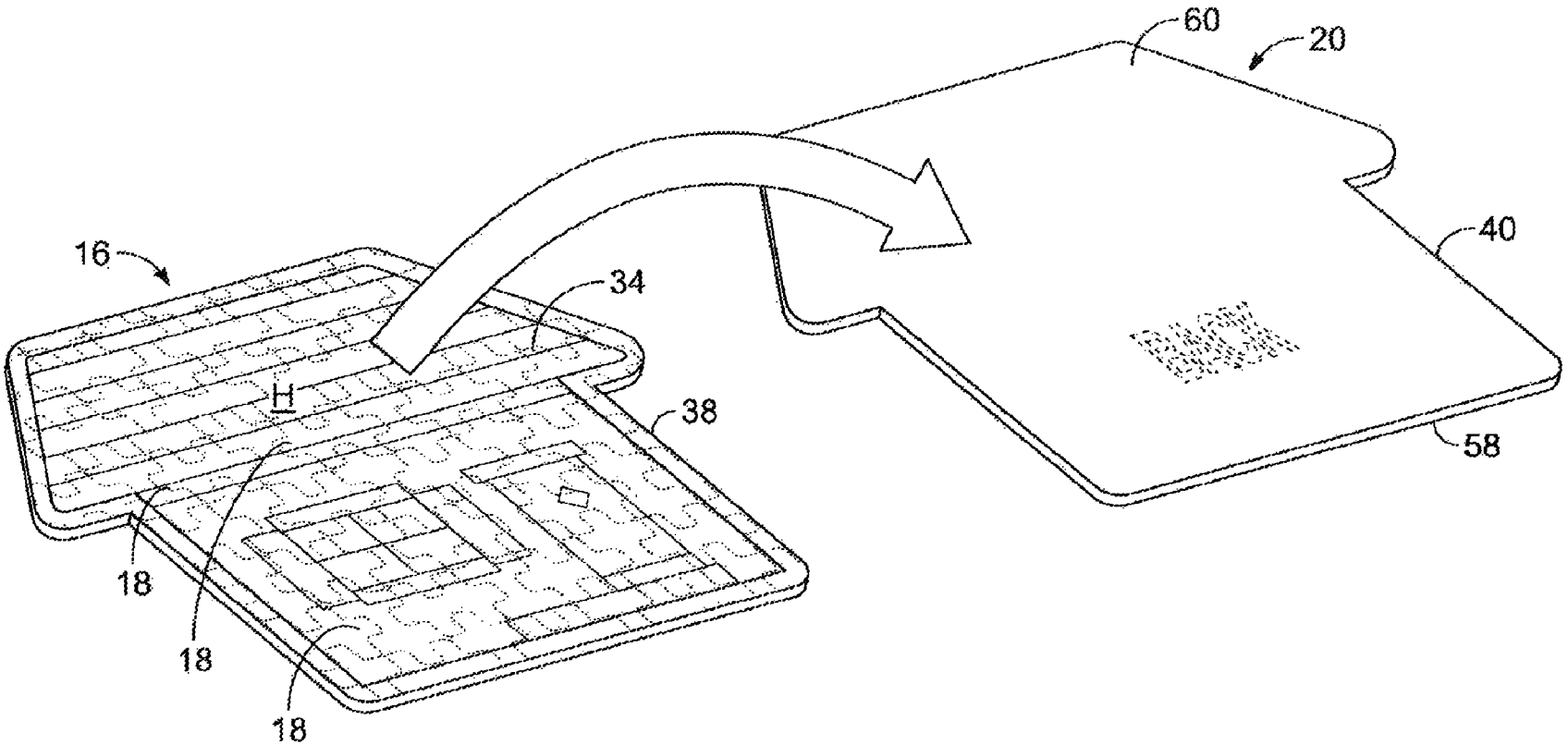
FIG. 7 is perspective view of the dimensional layer puzzle and the platform shown in FIGS. 3 and 4, respectively, the platform being shown positioned with its back side facing up.

FIGS. 6 and 7 illustrate the positioning used for determining and marking front and back sides 58, 60, respectively, of the platform 20, for purposes that are discussed hereinbelow. Although the outline 40 of the platform 20 is symmetrical, and either side of platform 20 may be designated the front side or the back side, it should be understood that it would be necessary to designate and mark the front and back sides of platforms that have non-symmetrical outlines, such as the platform 42.

Referring specifically to FIG. 6, the platform 20 is placed on the upper surface 34 of the dimensional layer puzzle 16, with its outline 40 aligned with outline 38 of the dimensional layer puzzle 16. The front side 58 of the platform 20 may then be marked, for example, with the word "front". Likewise, referring to FIG. 7, the platform 20 is flipped over and the back side 60 may then be marked, for instance, with the word "back". Also, front and back sides 62, 64, respectively, of the platform 42 (see FIG. 5) may also be determined and marked in a similar manner.

Figure 8:
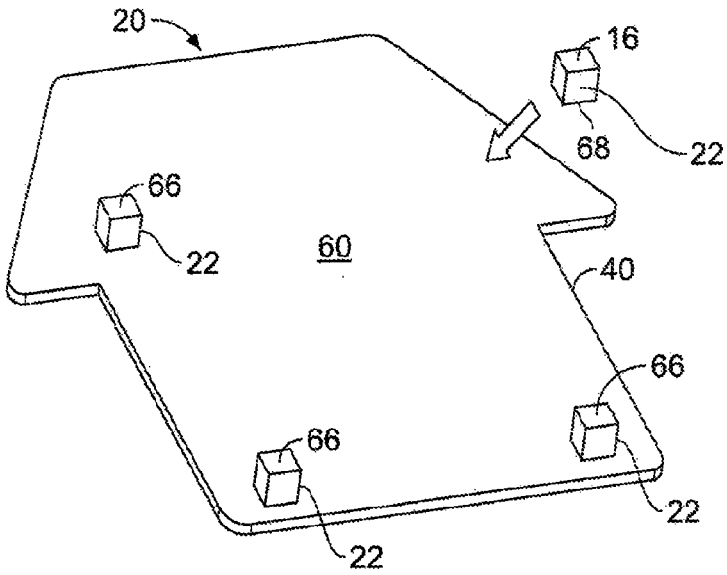
FIG. 8 is perspective view of the back side of the dimensional layer platform shown in FIG. 7 during the addition of the mounting blocks.
Figure 11:
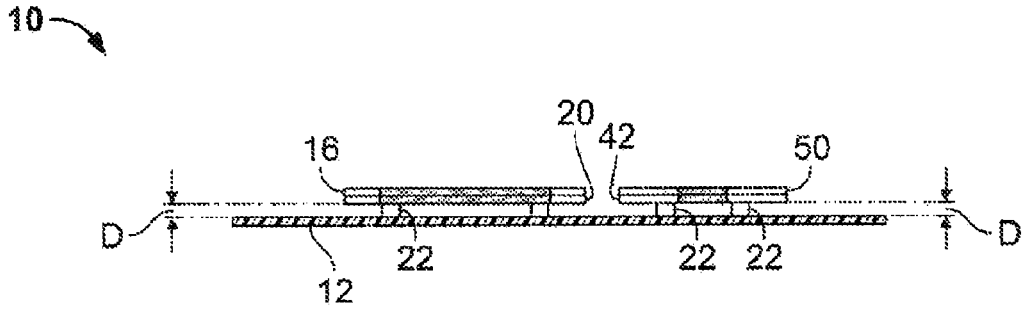
FIG. 11 a cross-sectional view, taken along section line 11-11 and looking in the direction of the arrows, of the multi-dimensional puzzle shown in FIG. 10.

FIG. 8 illustrates the positioning used for the placement and assembly of the mounting blocks 22 on the back side 60 of the platform 20, for a purpose that will be described hereinbelow. More particularly, each of the mounting blocks 22 has a height D, and top and bottom surfaces 66, 68. The mounting blocks 22 have adhesive (not shown) on the top and bottom surfaces 66, 68, the adhesive being covered with removable tape (not shown). In order to assemble the mounting blocks 22 to the platform 20, the user removes the tape from the bottom surfaces 68 of the of the mounting blocks 22 to thereby expose the adhesive. The bottom surfaces 68 are then positioned and the pressed against the back side 60 of the platform 20. The positioning of the mounting blocks 22 on the back side 60 of the platform 20 may be facilitated by a block placement diagram (not shown). While four blocks are shown, any number may be employed depending on the size of the dimensional layer puzzle 16 being supported to by the platform 20. There would be enough of the mounting blocks 22 so that some of them could be applied, in a similar fashion, to the back side 64 of the platform 42 (see FIGS. 10 and 11).

Figure 9:
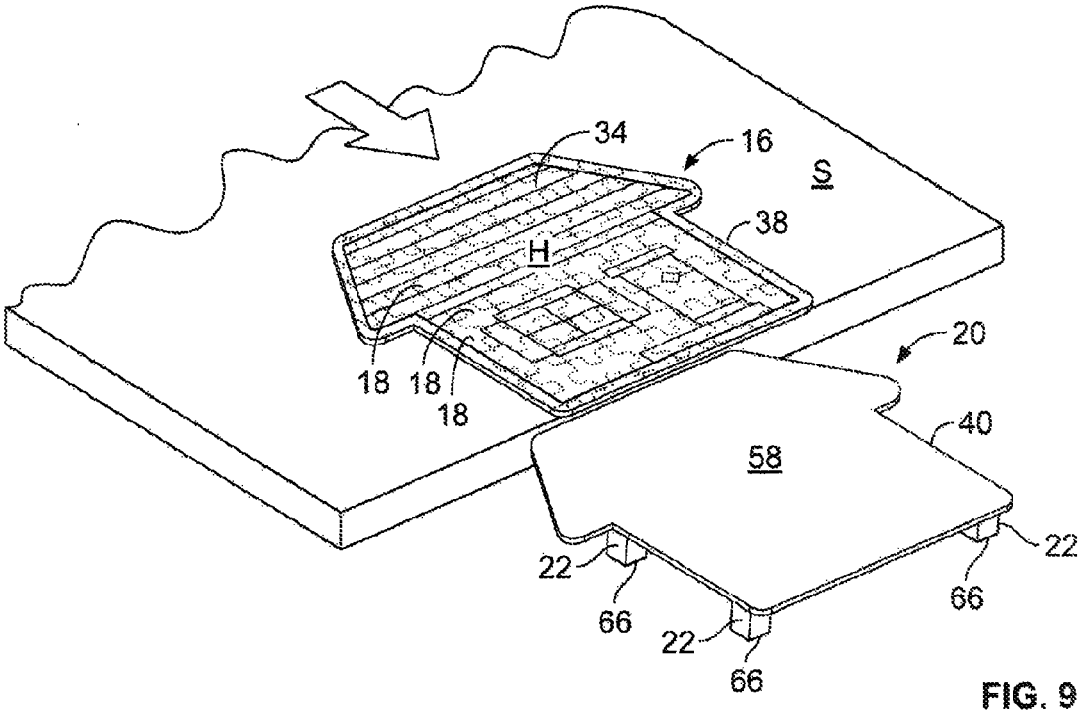
FIG. 9 is a perspective view of the puzzle of FIG. 3 as it is being positioned on the front side of the platform.

FIG. 9 illustrates the positioning used for the placement of the dimensional layer puzzle 16 on the platform 20. The platform 20 is first positioned adjacent to the flat surface S on which the dimensional layer puzzle 16 is resting, with its front side 58 facing upward and oriented in the same plane as the flat surface S. The puzzle 16 is then slid off the flat surface S onto the front side 58 of the platform 20. A similar process would be employed for the placement of the dimensional layer puzzle 50 on the platform 42.

In use, a player would first assemble the base layer puzzle 12. The dimensional layer puzzles 16, 50 and the platforms 20, 42 would then be assembled as described above. The mounting blocks 22 would be attached to the back sides 60, 64 of the platforms 16, 42, respectively, as described above. The dimensional layer puzzles 16, 50 would then be positioned on the platforms 20, 42, respectively, as described above. Finally, with reference to FIGS. 10 and 11, without removing the tape from the top surfaces 66 of the mounting blocks 22 (i.e., so as to avoid exposing the adhesive thereon), the platforms 20, 42 would be placed on the upper surface 24 of the of the base layer puzzle 12. More particularly, the platform 20 (which supports the dimensional layer puzzle 16 having the scene H) would be placed over the house scene 30, and the platform 42 (which supports the dimensional layer puzzle 50 having the tree scene T) would be placed over the tree scene 32, thereby movably (e.g., slidably) supporting the dimensional layer puzzles 16, 50 above and spaced apart from the base layer puzzle 12 by the height D of the blocks 22 (see FIG. 11). Of course, the dimensional layer puzzles 16, 50 could be immovably, but not necessarily irremovably, mounted to the base layer puzzle 12 by removing the tape from the top surface 66 of the mounting blocks 22. Also, the height D of each mounting block 22 could vary, thereby allowing the dimensional layer puzzle 16 to have a different height and/or angle of inclination compared to the dimensional layer puzzle 50.

Upon completion of the assembly of the multi-dimensional puzzle 10, it may be desired to prepare it for transportation and/or display in various positions (e.g., as wall-hanging art) without becoming disassembled. To accomplish this, the user may take the following steps: a) remove the dimensional layer puzzle 16/platform 20 unit and the dimensional layer puzzle 50/platform 42 unit from the base layer puzzle 12; b) carefully flip these units upside down on a work surface—this may be accomplished by placing thin pieces of cardboard over the puzzles 16, 50 to facilitate keeping the pieces 14, 18, respectively, in place while flipping same; c) lift the platforms 20, 42 off the dimensional layer sides puzzles 16, 50, respectively; d) spread an even layer of puzzle glue covering the entire front sides 58, 62 of the platforms 20, 42, respectively; (e) place the front sides 58, 62 of the platforms 20, 42, respectively, on the lower surfaces 36, 56 of the puzzles 16, 50, respectively, thereby gluing the pieces together; (f) apply an even layer of puzzle glue over the entire upper surface 24 of the base layer puzzle 12; (g) wait for the puzzle glue on the base layer puzzle 12 to dry; (h) remove the tape from the adhesive on the top surfaces 66 of the blocks 22; (i) place the dimensional layer puzzle 16/platform 20 unit and the dimensional layer puzzle 50/platform 42 unit directly over the corresponding house and tree scenes 30, 32, respectively, of the base layer puzzle 12 and press together to adhere.

It will be understood that the embodiments described herein are merely exemplary and that a person skilled in the art may make many modifications without departing from the spirit and scope of the invention. For instance, a plurality of three-dimensional layer puzzle pieces (not shown) may replace all of some of the two-dimensional puzzle pieces 14, 18, and/or 51. The three-dimensional layer puzzle pieces may have flat lower surfaces and contoured upper surfaces so that when assembled, the three dimensional layer puzzle would have a three-dimensional upper surface, thereby providing enhanced visual excitement to the multi-layer puzzle 10. The mounting blocks 22 may be rigid or they may be made from a flexible material (i.e., cellular foam). If made from a very flexible material, the mounting blocks 22 would allow some limited in and out and back and fourth movement of the dimensional layer puzzles 16, 50, relative to the base layer puzzle 12, thereby adding another visual feature (i.e., a "jiggling" and/or oscillating effect) to the novel multi-dimensional puzzle 10. Accordingly, all such variations and modifications are intended to be included within the scope of the present invention.

I claim:

1. A multi-dimensional puzzle, comprising:

a first jigsaw puzzle formed from a first set of inter-fitting puzzle pieces, said first jigsaw puzzle having a first size and a first shape;

a second jigsaw puzzle formed from a second set of inter-fitting puzzle pieces, said second jigsaw puzzle having a second size, which is smaller than said first size, and a second shape, which is different than said first shape; and mounting means for mounting said second jigsaw puzzle in a spaced relationship above a portion of said first jigsaw puzzle, said portion of said first jigsaw puzzle corresponding to a predetermined scene depicted therein, said scene having a third size, which is substantially the same as said second size, and a third shape, which is substantially the same as said second shape, wherein said second jigsaw puzzle depicts a replication of said predetermined scene, whereby said first and second jigsaw puzzles cooperate to provide said puzzle with a multi-dimensional appearance.

2. A multi-dimensional puzzle according to claim 1, wherein said scene corresponds to a single object depicted in said first jigsaw puzzle.

3. A multi-dimensional puzzle, comprising:

a first jigsaw puzzle formed from a first set of inter-fitting puzzle pieces, said first jigsaw puzzle having a first size and a first shape; and a second jigsaw puzzle formed from a second set of inter-fitting puzzle pieces, said second jigsaw puzzle having a second size, which is smaller than said first size, and a second shape, which is different than said first shape; and mounting means for mounting said second jigsaw puzzle in a spaced relationship above a portion of said first jigsaw puzzle, said mounting means including a platform, which has a planar support surface upon which all of said puzzle pieces of said second jigsaw puzzle are mountable, and a plurality of mounting blocks interposed between said platform and said first jigsaw puzzle, and wherein said platform has a third size, which is substantially the same as said second size, and a third shape, which is substantially the same as said second shape.

4. A multi-dimensional puzzle according to claim 3, wherein said mounting means functions to permit said second jigsaw puzzle to be movable relative to said first jigsaw puzzle.

5. A multi-dimensional puzzle according to claim 4, wherein said second jigsaw puzzle is slidable relative to said first jigsaw puzzle.

6. A multi-dimensional puzzle according to claim 4, wherein said second jigsaw puzzle is oscillatable relative to said first jigsaw puzzle.

7. A multi-dimensional puzzle according to claim 3, wherein said first set of puzzle pieces includes at least one contoured puzzle piece.

8. A multi-dimensional puzzle according to claim 3, wherein said second set of puzzle pieces includes at least one contoured puzzle piece.

9. A multi-dimensional puzzle according to claim 1, wherein said scene is represented on a subset of said first set of puzzle pieces.

10. A multi-dimensional puzzle according to claim 9, wherein said subset includes puzzle pieces the same as said second set of puzzle pieces.

11. A multi-dimensional puzzle according to claim 9, wherein said subset includes puzzle pieces different than said second set of puzzle pieces.

12. A multi-dimensional puzzle according to claim 3, wherein said portion of said first jigsaw puzzle corresponds to a scene depicted therein.

13. A multi-dimensional puzzle according to claim 12, wherein said second jigsaw puzzle corresponds to the said scene.

14. A multi-dimensional puzzle according to claim 13, wherein said scene is formed on a subset of said first set of puzzle pieces.

15. A multi-dimensional puzzle according to claim 14, wherein said subset includes puzzle pieces the same as said second set of puzzle pieces.

16. A multi-dimensional puzzle according to claim 14, wherein said subset includes puzzle pieces different than said second set of puzzle pieces.

17. A multi-dimensional puzzle according to claim 12, wherein said scene corresponds to a single object depicted in said first jigsaw puzzle.

18. A multi-dimensional puzzle according to claim 1, wherein said mounting means includes a platform having a planar surface that supports said second jigsaw puzzle thereon.

19. A multi-dimensional puzzle according to claim 18, wherein said mounting means includes a plurality of mounting blocks interposed between said platform and said first jigsaw puzzle.

20. A multi-dimensional puzzle according to claim 18, wherein said platform has a fourth size, which is substantially the same as said third size, and a fourth shape, which is substantially the same as said third shape.

21. A multi-dimensional puzzle according to claim 1, wherein said mounting means functions to permit said second jigsaw puzzle to be moveable relative to said first jigsaw puzzle.

22. A multi-dimensional puzzle according to claim 21, wherein said second jigsaw puzzle is slidable relative to said first jigsaw puzzle.

23. A multi-dimensional puzzle according to claim 21, wherein said second jigsaw puzzle is oscillatable relative to said first jigsaw puzzle.

24. A multi-dimensional puzzle according to claim 1, wherein said first set of puzzle pieces includes at least one contoured puzzle piece.

25. A multi-dimensional puzzle according to claim 1, wherein said second set of puzzle pieces includes at least one contoured puzzle piece.

* * * * *